United States Patent [19]

Denbleyker

[11] Patent Number: 4,801,306

[45] Date of Patent: Jan. 31, 1989

[54] QUENCH RING FOR A GASIFIER

[75] Inventor: Alfred L. Denbleyker, Houston, Tex.

[73] Assignee: Texaco Inc., White Plains, N.Y.

[21] Appl. No.: 44,696

[22] Filed: May 1, 1987

[51] Int. Cl.[4] ..... C10J 3/72

[52] U.S. Cl. ..... 48/69; 261/112.1; 422/207

[58] Field of Search ..... 48/69, DIG. 2, 77, 62 R; 422/207; 55/256; 261/112.1, 121.1; 196/140; 110/171, 215, 216

[56] References Cited

U.S. PATENT DOCUMENTS

| | | | |
|---|---|---|---|
| 2,896,927 | 7/1959 | Nagle et al. | 261/112.1 |
| 3,164,644 | 1/1965 | De Ghetto et al. | 261/112.1 |
| 4,073,627 | 2/1978 | Anderson | 48/62 R |
| 4,218,423 | 8/1980 | Robin et al. | 422/207 |

FOREIGN PATENT DOCUMENTS

| | | | |
|---|---|---|---|
| 2014284 | 8/1979 | United Kingdom | 48/DIG. 2 |

*Primary Examiner*—David L. Lacey
*Assistant Examiner*—Joye L. Woodard
*Attorney, Agent, or Firm*—Robert A. Kulason; James J. O'Loughlin; Robert B. Burns

[57] ABSTRACT

Gasifier for combusting a carbonaceous fuel to produce a usable gas and comprising an insulated outer shell. A combustion chamber within the shell receives a fuel mixture from a fuel injection burner. The products of combustion, including hot produced gas, are passed through a constricted throat to be cooled ion a liquid bath. A dip tube which guides the hot products into the bath, is provided with a stream of coolant from a quench ring. The latter is supported on the dip tube upper end and conformed at its exposed face to minimize the effects of the hot product gas, thereby avoiding the establishment of stress points in the ring structure.

4 Claims, 2 Drawing Sheets

QUENCH RING FOR A GASIFIER

BACKGROUND OF THE INVENTION

In the production of a usable gas by the combustion of a carbonaceous fuel, the process is operated most effectively under a high temperature and high pressure conditions. For example, for the production of a gas from a particulated coal or coke, a preferred operating temperature range of about 2400° to 2600° F. is maintained, at a pressure of between about 5 to 250 atmospheres.

The harsh operating conditions prevalent in such a method, and in particular the wide temperature variations experienced, imposes a severe strain on many segments of the gasifier or reactor unit. The present invention is addressed to an improvement in the structure of the gasifier, and particularly to the quench ring and the dip tube structure. The latter, by their functions in the apparatus, are exposed to the maximum temperature conditions by virtue of the hot product gas which comes in contact with these members directly from the combustion chamber.

U.S. Pat. No. 4,218,423, issued Aug. 18, 1980 to Robin et al., illustrates one form of quench ring and dip tube which can be improved through use of the present arrangement. The industry, however, has experienced a chronic defect in gasifier construction due to the physical stress imposed on the quench ring. This comes as a result of its proximity to the hot gas, as well as to the flow of liquid coolant which it conducts.

These difficulties, experienced as a result of high temperature conditions, generally manifest themselves in the form of minute cracks and fissures which develop in the quench ring. The latter tend to form in areas particularly where sharp corners are present such that any physical or thermal stress would be magnified and precipitate water leakage into the gasifier.

Further, the toroidal configuration of a quench ring often prompts the development of permanent strains and cracks due to the thermal expansion of the ring.

Toward overcoming this prevalent operating defect in gasifiers of the type contemplaced, there is presently disclosed a combination dip tube and quench ring which are so positioned and interrelated as to minimize thermal stresses normally encountered during a gasification period. Further, the water carrying quench ring is segmented into a plurality of members which are cooperatively arranged in a circular configuration with water cooled expansion joints between the respective segments.

It is therefore an object of the invention to provide an improved gasifier for producing a usable gas, in which the dip tube is wetted by a coolant holding quench ring.

A further object is to provide a liquid cooling system for a gasifier which minimizes thermal expansion stresses in the quench ring due to high temperature expansion realized due to contact with produced gas being conducted from the gasifier's combustion chamber.

A still further object is to provide a gasifier cooling system wherein a novel liquid holding, segmented quench ring is positioned to cool the dip tube while minimizing thermal stress to itself.

DESCRIPTION OF THE PREFERRED EMBODIMENTS

Figure 1:
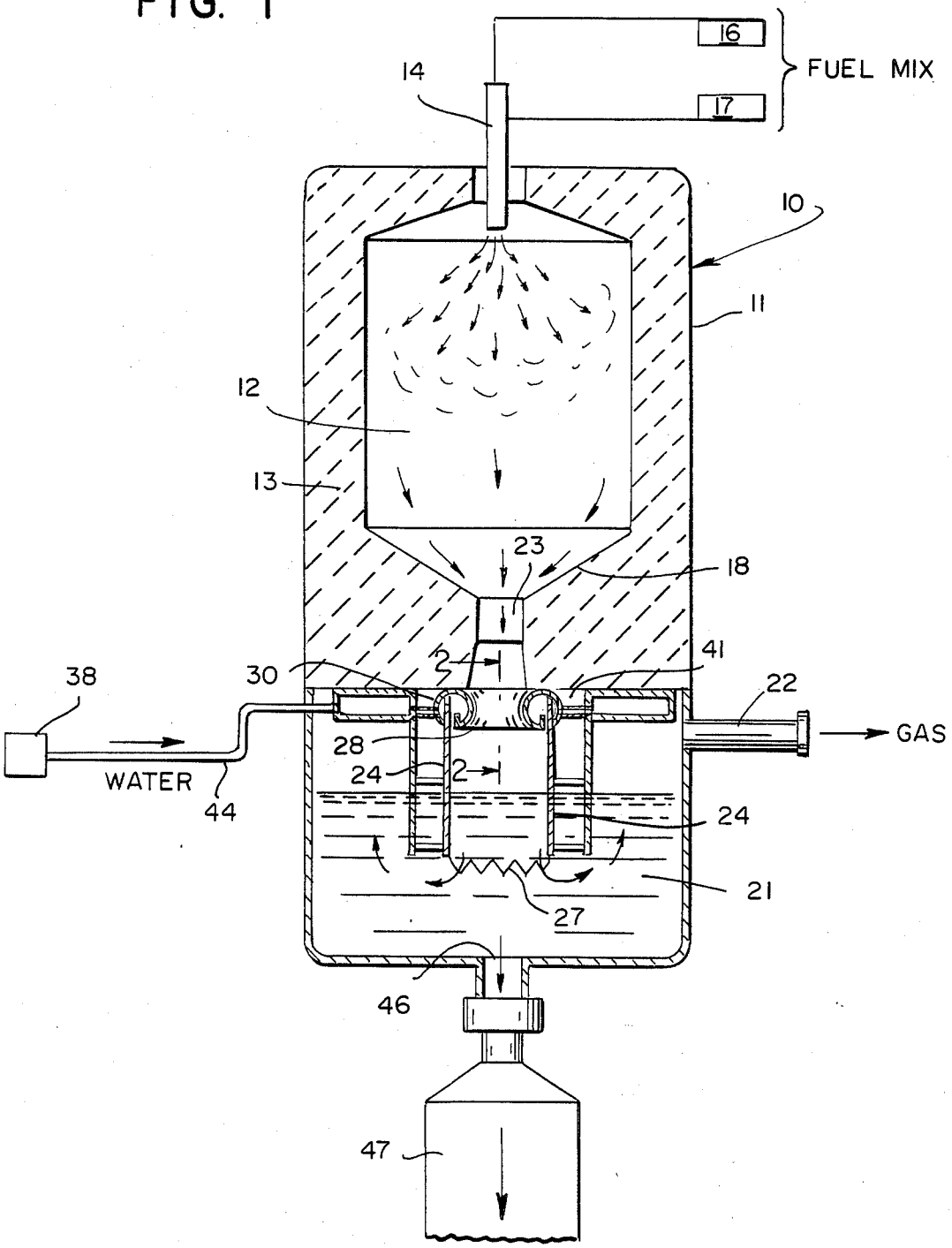
FIG. 1 is an elevation view in cross-section having a gasifier presently contemplated.

Stated briefly, in achieving these objectives, and referring to FIG. 1, there is shown a gasifier or reactor for combusting a carbonaceous fuel either solid or gaseous. The reaction will produce a useful gas and a hot effluent, normally in the form of particulated ash and gas. The gasifier or reactor is embodied in an insulated refractory lined shell which is positioned uprightly to form a downflow stream of effluent which includes hot produced gas as well as ash particles.

A combustion chamber within the shell receives a pressurized stream of fuel mixture from a fuel injection burner. The latter is communicated to a source of the carbonaceous fuel, as well as to a source of combustion supporting gas such as oxygen or air.

The hot products of combustion generated in the combustion chamber are passed through a constricted throat in the gasifier shell to be cooled in a quench chamber holding a liquid bath.

To facilitate passage of effluent gas from the constricted throat, a dip tube guides the hot products downwardly into the bath. The dip tube, positioned in a generally upright orientation, includes a quench ring which directs a stream of liquid coolant along the dip tube exposed guide face concurrently with impingement of product gas thereagainst.

Referring again to FIG. 1, a gasifier 10 of the type contemplated embodies an elongated metallic shell 11, normally operated in an upright or vertical disposition. The shell includes a combustion chamber 12 at the upper end. To withstand the high operating temperatures experienced during the gasification process, combustion chamber 12 is provided with an insulated inner wall 13 formed of a refractory material.

A burner 14 is positioned at the shell upper end to inject a carbonaceous fuel such as particulated coal or coke from a source 16, into combustion chamber 12, together with an amount of a combustion supporting gas from a pressurized source 17.

The present invention can be applied to gasifiers burning a variety of carbonaceous fuels. To illustrate the apparatus and its use, it will be assumed that burner 14 is communicated with a source 16 of coke. The fuel has been ground and formed into a slurry by the addition of sufficient water. The pressurized gas at source 17 is oxygen.

The lower end of combustion chamber 12 is defined by an inwardly sloped insulated floor 18. This shape enhances the discharge of both solid and gaseous products which have been produced in said combustion chamber 12.

The lower end of shell 11 encloses a quench chamber or cooling zone 19 into which the products of combustion are directed. Here they contact a liquid coolant bath 21 normally communicated with a water supply.

Subsequent to the hot gaseous segment of the combustion products or effluent being cooled in bath 21, it is passed through a discharge opening 22 in shell 11 to be further processed in downstream equipment and operations.

Combustion chamber 12 and quench chamber 19 are communicated through a constructed throat 23 formed in the combustion chamber floor 18. To achieve greater cooling efficiency, quench chamber or cooling zone 19 is provided with a dip tube 24 having an upper edge 26 positioned adjacent to constricted throat 23. Dip tube 24 further includes a lower edge 27 which terminates beneath the surface of coolant bath 21.

Dip tube 24 is supported within quench chamber 19 such that the inner wall 29 thereof defines a cylindrical guide passage 28 for hot gas as well as for other products leaving throat 23. As the pressurized gas stream is introduced to water bath 21, it will be substantially cooled, depending on the temperature, before bubbling up and flowing through discharge port 22.

As is known in the prior art, the flow of gas through the dip tube gas guide path 28 can be facilitated, and thermal damage to the dip tube minimized by providing the latter along its gas contacting face or surface 29, with a film of water. A pressurized stream of the latter is thereby introduced to the dip tube 24 upper end and caused to flow downward along inner wall 29 and into bath 21.

The prior art has dealt with the concept of a dip tube, as well as with means for applying a stream of water to the contact surfaces of the latter. However, and as herein noted, the high temperature of the produced gas which leaves constricted throat 23, can contact, and be detrimental to metal surface closest to the throat. Most pointedly affected in this respect is the quench ring 30 fixedly positioned adjacent dip tube 24.

Figure 2:
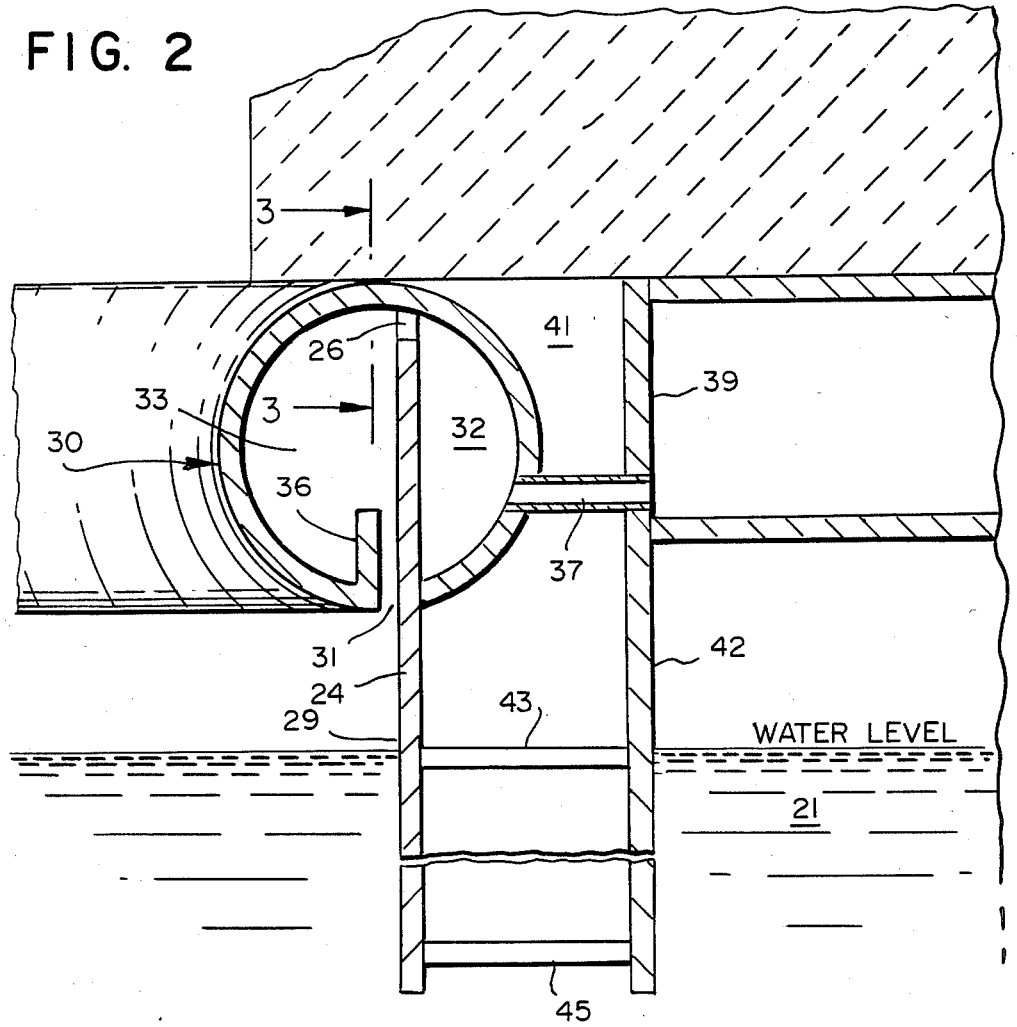
FIG. 2 is a segmentary view on an enlarged scale taken along line 2—2 in FIG. 1.
Figure 3:
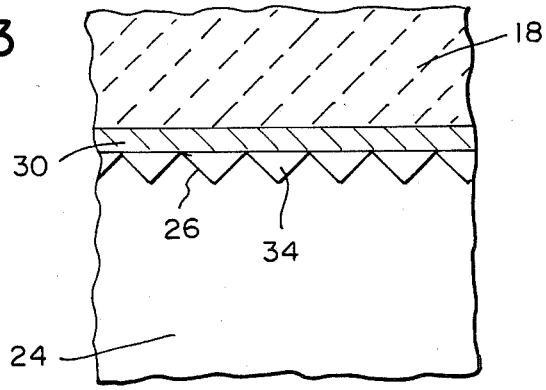
FIG. 3 is a segmentary view taken along line 3—3 of FIG. 2.

In the embodiment shown in FIGS. 2 and 3, dip tube 24 is supported in a generally vertical disposition having upper edge 26 nearest to constricted throat 23. Support of dip tube 24 can be through suitable brackets or the like which depend from the wall of shell 11, or which can depend from the floor 18 of combustion chamber 12.

In either instance, the upper edge 26 of dip tube 24 is positioned to engage quench ring 30 at a point adjacent to the underside of combustion chamber floor 18.

Quench ring 30 as shown is shaped preferably in the configuration of a ring, and most preferably assumes a toroidal configuration.

The most susceptible part of quench ring 30 for the present arrangement, resides at the inner, exposed surface. This curved part of the ring wall is exposed to the hot product gases immediately as they leave throat 23, and forms a segment of the dip tube guide path.

In the shown embodiment of FIG. 3, quench ring 30 can assume a generally circular cross-section. Thus, the quench ring can be fabricated in the form of a relatively thin walled metallic member such as a steel pipe, tubing or the like.

The underside of quench ring 30 is slotted at a peripheral opening to position a drain port 31 adjacent to the dip tube 24 inner surface 29.

Upper edge 26 of dip tube 24 as shown, registers in peripheral port 31, in a manner that said upper edge which preferably terminates in a corrugated surface, can be in supporting engagement with the quench ring inner wall.

Quench ring 30 and dip tube 24, can be welded along this support joint whereby the dip tube wall forms segregated, compartments 33 within the quench ring. Passages 34 defined by the serrated dip tube edge forms a plurality of connecting passages 34 between the respective compartments.

Discharge compartment 33 as shown, is provided with a lip or rim 36 which extends upwardly into said chamber, preferably parallel to the adjacent dip tube 24, thereby forming an elongated flow passage 31. The parallel edges will define a narrow passage 31 through which the pressurized coolant water stream will flow.

Inlet compartment 32 is communicated in one embodiment by way of one or more conduits 37, with a distribution ring 39. The latter is in turn connected with a source of water 38.

In the disclosed arrangement, and referring to FIG. 2, distribution ring 39 is spaced radially outward from the quench ring 30 and beneath floor 18, thereby defining an annular space 41 therebetween. Distribution ring 39 comprises primarily a manifold which is positioned contiguous with floor 18 and can be supported from floor 18 in a manner to encircle quench tube 24. The distribution ring 39 can be communicated by one or more conduits 44 to the source of coolant water at 38.

Coolant source 38 is maintained or recirculated with a sufficient pressure to assure water flow into pressurized quench chamber 19. Distribution ring 39 further includes an elongated support element 42 which extend downwardly to supportably engage dip tube 24 at a plurality of cross braces 43 and 45. The latter are disposed at spaced intervals to position the dip tube during the severe operating conditions.

Structurally, quench ring 30 as shown, is in the form of a toroidal body. This, however, can be altered by providing the latter with an alternate curved configuration devoid of sharp corners or zones which would be susceptible to excessive thermal stress when subjected to contact with the high temperature produced gases.

Operationally, a carbonaceous fuel is combusted in gasifier combustion chamber 12. The hot products, and particularly the hot gas, will emerge from constricted throat 23 at a temperature within the range of about 2200° C.-3000° C. The hot gas stream, under the pressurized atmosphere within combustion chamber 12, will flow rapidly downwardly through dip tube guide passage 28.

The hot produced gas will carry with it the residual ash or other solid particles which result from the combustion event. These solids, particularly the larger ones, will be removed from bath 21 by way of drain 46 and lock hopper 47 for disposal.

Since quench ring 30 is segregated into adjacent compartments 32 and 33, inlet compartment 32 will remain substantially full of the coolant water. The latter will overflow through connecting passage 36 at the upper serrated edge 26 of dip tube 24, and into discharge compartment 33. Thereafter the water still under pressure will flow by way of constricted discharge passage 31 along the dip tube 24 inner face 29.

Approximately one-half of quench ring 30 outer surface is exposed to the high temperature through contact with the hot produced gas. The coolant compartment 33, however, is maintained at a minimal temperature due to continuous water flow therethrough.

Normally, with such a wide temperature differential in the same metallic member or body, i.e. quench ring 30, there will be a tendency to establish thermal stress areas or points to be established in the structure of the quench ring. However, with the configuration of quench ring 30 exposed surface, thermally stressed areas will be avoided.

It is understood that although modifications and variations of the invention can be made without departing from the spirit and scope thereof, only such limitations should be imposed as are indicated in the appended claims.

I claim:

1. In a gasifier for the high temperature combustion of a carbonaceous fuel to produce a usable gas, which gasifier includes an insulated shell having a combustion chamber in which the fuel is burned at an elevated temperature and pressure, a quench chamber in said shell holding a liquid bath for cooling products of combustion, a constricted throat communicating the respective combustion chamber and quench chamber, and an elongated dip tube having an inner wall which defines a flow guide path between said combustion chamber and said quench chamber, and having opposed upper and lower edges, the improvement therein of a quench ring supportably positioned at said dip tube upper edge and communicated with a pressurized source of liquid coolant, a drain passage in the quench ring for discharging a flow of liquid coolant along the dip tube inner wall to wet the surface thereof, said quench ring having a curved exterior face positioned contiguous with the dip tube inner wall to define a segment of the said flow guide path, and said dip tube upper edge being registered in said quench ring drain passage to segregate said quench ring into inlet and discharge compartments, respectively.

2. In the gasifier as defined in claim 1 wherein said quench ring includes conduit means communicating said inlet compartment with the pressurized source of liquid coolant.

3. In the gasifier as defined in claim 1 wherein said dip tube upper edge forms a transverse connecting passage between the inlet and discharge compartments.

4. In the gasifier as defined in claim 3 wherein the dip tube upper edge is serrated and engages the quench ring to form said transverse liquid connecting passage.

* * * * *